United States Patent [19]

Fuller

[11] 4,160,441

[45] Jul. 10, 1979

[54] FIREPLACE UTENSIL

[76] Inventor: Frank M. Fuller, 5415 Verdant Way, Houston, Tex. 77069

[21] Appl. No.: 802,647

[22] Filed: Jun. 2, 1977

[51] Int. Cl.[2] ..... F24C 3/12

[52] U.S. Cl. ..... 126/127; 126/25 C; 110/253

[58] Field of Search ..... 126/92 R, 92 AC, 127, 126/25 C, 120; 110/1 F

[56] References Cited

U.S. PATENT DOCUMENTS

| | | | |
|---|---|---|---|
| 374,801 | 12/1887 | Fuller | 126/127 |
| 435,299 | 8/1890 | Grant | 126/127 |
| 702,049 | 6/1902 | Draper | 110/1 F |
| 2,117,865 | 5/1938 | Weber | 126/25 C |
| 3,696,801 | 10/1972 | Whitehead | 126/127 |

*Primary Examiner*—John J. Camby
*Assistant Examiner*—Larry J. Schwartz
*Attorney, Agent, or Firm*—Arnold, White & Durkee

[57] ABSTRACT

A fireplace utensil for use with a fireplace having a gas inlet pipe disposed in the bottom of the fireplace is disclosed which includes an elongated cover member and an elongated handle attached to said cover member, said fireplace utensil being adapted to be placed upon the gas inlet pipe to prevent particulate matter from entering and blocking the gas jets of the gas inlet pipe.

7 Claims, 7 Drawing Figures

FIREPLACE UTENSIL

BACKGROUND OF THE INVENTION

1. Field of the Invention

The invention relates to a fireplace utensil which is used in fireplaces having a gas inlet pipe, to prevent particulate matter, such as ashes, from entering and blocking gas jets of the gas inlet pipe.

2. Description of the Prior Art

Many fireplaces in use today throughout the United States utilize natural gas for initially igniting the logs to be burned in the fireplace. The natural gas, or other gaseous combustible material, is directed into the fireplace via a small diameter pipe, or gas inlet pipe, which is disposed in the bottom of the fireplace. The gas inlet pipe has a plurality of openings, or gas jets, disposed along its longitudinal axis, and which generally open toward and face the upper portion of the fireplace. Upon opening a suitable valve, the gas passes through the gas inlet pipe and exits therefrom through the gas jets. After the valve is opened, an individual ignites the gas, normally with a match or other igniting means. As the gas burns, it in turn ignites the logs which are normally supported above the gas jets by a conventional fireplace grate. The logs are usually wooden logs, but recently, fireplace logs have been made up of old newspapers or other fibrous materials. Furthermore, the terms "logs" encompasses any combustible material burned in a fireplace and which produces an ash residue.

After the burning gas has sufficiently ignited the logs in the fireplace, the gas inlet valve is closed and the logs will continue to burn in their normal course. As the fire continues to burn, a fine ash resulting from the combustion of the logs is formed and falls from the grate to the bottom of the fireplace. As this particulate matter, or fine ash, falls from the grate, it collects in the bottom of the fireplace and also upon the top of the gas inlet pipe, wherein the gas jets are normally located. Naturally, some of the ash will enter the gas inlet pipe via the gas jets. Furthermore, as the fire continues to burn, or after subsequent fires, the ashes will accumulate, eventually covering the gas inlet pipe if the collected ashes are not removed after each fire. Additionally, larger pieces of ash may likewise be formed by the combustion of the logs, and these larger pieces of ash fall upon the gas inlet pipe thus becoming lodged within the gas jets.

Over a perid of time, the gas jets may become inoperable due to their being blocked and clogged by a collection of ash within the gas inlet pipe and/or larger pieces of ash being disposed within the gas jets.

One suggested solution to the foregoing problem has been to leave the gas valve open, whereby gas is continuously being forced through the gas jets, and ignited, whereby the ashes will not collect over the gas jets. However, there are many disadvantages to this proposed solution. It is highly uneconomical due to the increasing cost of natural gas, as well as being wasteful of a critical national resource. Additionally, the burning gas causes the logs in the fireplace to be consumed by the fire at a faster rate than would be encountered were the ignited gas jets to be turned off, which is also wasteful and uneconomical.

Other solutions to the problem of clogged and blocked gas inlet pipes and gas jets are to periodically disconnect the gas inlet pipe and empty it of collected ash, and/or clear the gas jets with a small diameter sharp object such as a nail or wire. The former solution is time consuming, as well as not being readily performed by the average home owner who might not have the appropriate tools or plumbing know-how. The latter solution is ineffective because of the accumulation of ash or particular matter in the gas pipe.

Accordingly, prior to the development of the present invention, there has been no satisfactory means for economically and easily preventing the blockage of the gas jets disposed in a gas inlet pipe within a fireplace. Therefore, the art has sought an efficient, easily used, and economical fireplace utensil for preventing particulate matter from entering and blocking the gas jets of a gas inlet pipe disposed within a fireplace.

SUMMARY OF THE INVENTION

In accordance with the invention the foregoing has been achieved by the present fireplace utensil. The fireplace utensil of the present invention comprises an elongated cover member having an upper portion and depending side portions, an elongated handle attached to said cover member and extending outwardly from said cover member, and the fireplace utensil is adapted to be placed upon a gas inlet pipe with the longitudinal axis of the cover member being generally aligned with the longitudinal axis of the gas inlet pipe to prevent particulate matter from entering and blocking the gas jets of the gas inlet pipe and from accumulating within the gas inlet pipe.

As indicated above, in more specific terms, the upper portion and depending side portions of the cover member of the fireplace utensil define a generally concave enclosure having a cross-sectional configuration which generally conforms to the cross-sectional configuration of the gas inlet pipe. Additionally, the elongated handle attached to the cover member is substantially perpendicular to the longitudinal axis of the cover member.

A feature of the present invention resides in the fact that one end of the elongated cover member may be provided with a closure member which is contiguous with the upper and depending side portions of the cover member, and is adapted for abutting engagement with one end of the gas inlet pipe to assist in aligning the cover member with the gas inlet pipe, whereby the cover member will overlie all of the gas jets of the gas inlet pipe.

Additional features of the present invention include the utilization of a cover member which defines a generally concave enclosure having a semi-cylindrical cross-sectional configuration.

The fireplace utensil of the present invention when compared with previously proposed solutions to the problems of preventing the blocking and clogging of a gas inlet pipe, and gas jets disposed therein, has the advantages of efficiency, economy, and ease of use.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
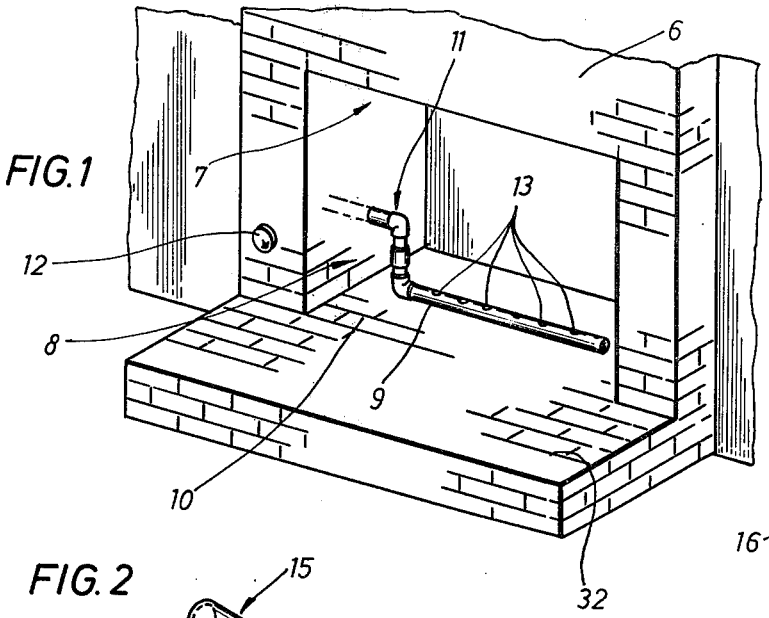
FIG. 1 is a perspective view of a typical fireplace, having a gas inlet pipe disposed therein.

Turning first to FIG. 1, a conventional fireplace 6 having an upper portion 7 and a lower portion 8 is shown. Conventional fireplace 6 may also include a raised hearth 32 as shown in FIG. 1. Fireplace 6 includes an elongated gas inlet pipe 9 disposed therein with its longitudinal axis lying in a plane substantially parallel with the bottom portion 8 of fireplace 6. Gas inlet pipe 9 lies in close proximity to the bottom surface 10 of fireplace 6, and is connected to a suitable source of natural gas via piping connections generally shown at 11. Fireplace 6 also includes a gas valve 12 for controlling the supply of natural gas which flows to gas inlet pipe 9 via piping connection 11. Gas inlet pipe 9 is also provided with a manifold (not shown) which provides air for the combustion of the gas.

Normally, gas inlet pipe 9 is comprised of a small diameter pipe of about ½ inch in diameter; however, it should be readily realized that the present invention is not limited to a particular size of gas inlet pipe 9.

Gas inlet pipe 9 has a plurality of gas jets, or holes 13 disposed along the longitudinal axis of gas inlet pipe 9. Gas jets 13 generally face toward the upper portion 7 of fireplace 6. As previously described, combustion of logs (not shown) supported in a grate (not shown) above gas inlet pipe 9 results in particulate matter, or a fine ash and larger pieces of ash (not shown), accumulating about and over gas inlet pipe 9 and gas jets 13. This particulate matter, as previously discussed, leads to clogging and blockage of gas inlet pipe 9 and gas jets 13.

Figure 2:
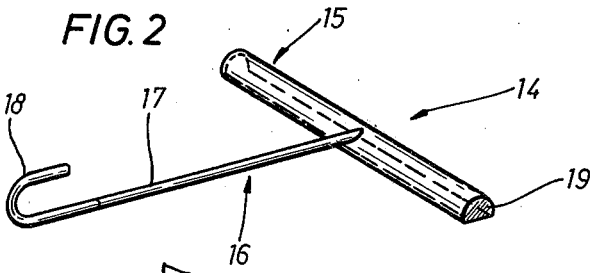
FIG. 2 is a perspective view of one embodiment of the fireplace utensil of the present invention.

Referring now to FIG. 2, the fireplace utensil 14 of the present invention is shown. Fireplace untensil 14 is comprised of an elongated cover member 15, which has an elongated handle 16 attached to cover member 15 and extends outwardly from cover member 15. Cover member 15 and handle 16 may be made of any non-combustible material, such as any type of metal, as well as materials such as asbestos. Cover member 15 may be formed of sheet metal by stamping or forging, by casting it within a mold (not shown), by extruding it or in any other suitable fashion. Handle 16 may be preferably made of rod stock material, or of any stock material, since its cross-sectional configuration is not critical. Accordingly, handle 16 could have a square, triangular, or any other suitable cross-sectional configuration. Handle 16 is attached to cover member 15 in any suitable manner, such as by welding, epoxy glue, by means of a threaded connection, or may be formed integrally with cover member 15. The length of cover member 15 should be such that when it is placed upon gas inlet pipe 9 with its longitudinal axis being generally aligned with the longitudinal axis of gas inlet pipe 9, cover member 15 will cover all of the gas jets 13 disposed along gas inlet pipe 9. Cover member 15 is continuous, insofar as cover member 15 is formed of a continuous piece of suitable material which does not have any openings or slots therein. Accordingly, undesirable particulate matter from the burning logs is prevented from passing through cover member 15 and accumulating between cover member 15 and gas inlet pipe 9, which particulate matter would block gas jets 13 of gas inlet pipe 9.

Still referring to FIG. 2, it should be noted that handle 16 could also be made of a combination of combustible and non-combustible materials. For example, a portion 17 of handle 16 could be made of non-combustible material such as any suitable metal and another portion 18 of a combustible material, such as wood. Outer end portion 18 of handle 16 may have any suitable configuration, including the U-shaped configuration shown in FIG. 2, or other decorative configurations (not shown).

Cover member 15 may be provided with a closure member 19 at one end of cover member 15. Closure member 19 may be contiguous with the upper portion and depending side portions of cover member 15, to be hereinafter described, or contiguous with the upper portion and one depending side portion, or contiguous with both depending side portions, such as with a pin or strap (not shown), whereby one end of cover member 15 is partially closed. Closure member 19 is adapted for abutting engagement with one end of gas inlet pipe 9 to assist in aligning the cover member 15 with the gas inlet pipe 9, whereby cover member 15 will overlie all of the gas jets 13 of the gas inlet pipe 9, as to be hereinafter discussed.

It should be readily realized that the present invention is not limited to any particular configuration of handle 16 or material or method of manufacture for cover member 15 and handle 16.

Figure 3:
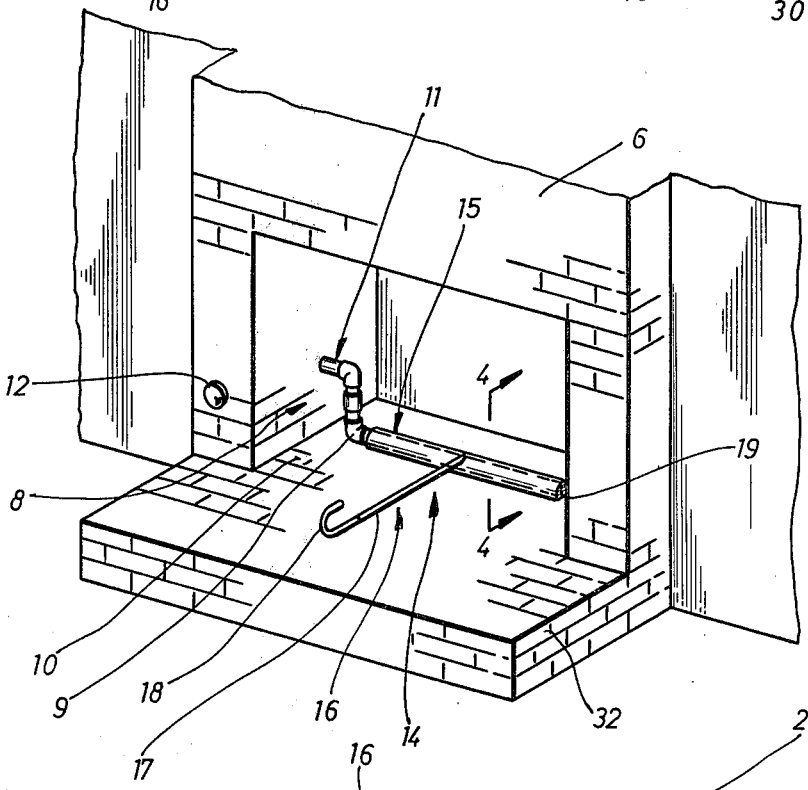
FIG. 3 is a perspective view of a fireplace provided with one embodiment of the fireplace utensil of the present invention.

Turning now to FIG. 3, the fireplace utensil 14 of the present invention is shown in use in a fireplace 6 which has a gas inlet pipe 9 disposed in the lower portion 8 of fireplace 6. After the logs (not shown) in fireplace 6 have been ignited, gas valve 12 is closed, thereby shutting off the supply of gas passing through gas inlet pipe 9. Shortly after turning off valve 12, fireplace utensil 14 is placed upon gas inlet pipe 9, with the longitudinal axis of cover member 15 being generally aligned with the longitudinal axis of the gas inlet pipe 9, and positioned to cover all the gas jets 13, whereby particulate matter, or ashes (not shown), are prevented from entering and blocking gas jets 13 and gas inlet pipe 9.

In placing cover member 15 of fireplace utensil 14 upon gas inlet pipe 9, cover member 15 is placed upon gas inlet pipe 9 to cover the gas jets 13 and, in one embodiment, is moved toward piping connection 11 until closure member 19 of cover member 15 is an abutting engagement with one end of the gas inlet pipe 9 thereby assisting in aligning cover member 15 with the gas inlet pipe 9, so that cover member 15 will overlie all of the gas jets 13 of the gas inlet pipe 9.

Still referring to FIG. 3, it is seen that handle 16 extends outwardly from cover member 15, a sufficient length to enable handle end portion 18 to be grasped and moved, without the danger of getting too close to the fire contained within fireplace 6. In the case of fireplaces having a hearth 32, handle 16 may lie upon hearth 32; however, if the fireplace 6 does not have a hearth 32, handle 16 will be generally be supported upon the bottom surface 10 of fireplace 6.

After the fire contained within fireplace 6 has ceased, fireplace utensil 14 remains in the position shown in FIG. 3, until it is desired to start another fire in fireplace 6. At that point in time, fireplace utensil 14 is removed from its position overlying gas inlet pipe 9 by lifting it upwardly and away from gas inlet pipe 9, whereby any particulate matter disposed above gas inlet pipe 9 and gas jets 13 is removed and prevented from entering and blocking gas inlet pipe 9 and gas jets 13.

Figure 4:
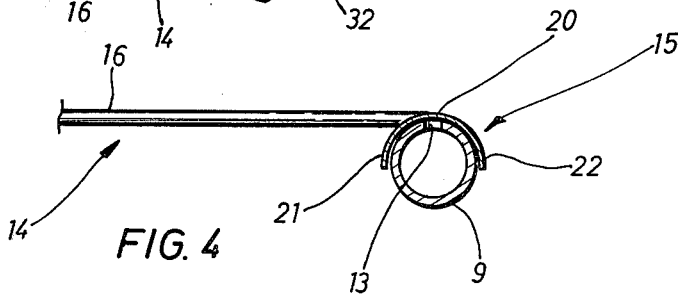
FIG. 4 is a cross-sectional view of the fireplace utensil and gas inlet pipe taken along line 4—4 of FIG. 3.

Turning now to FIG. 4, a fireplace utensil 14 in accordance with a preferred embodiment of the present invention will be described in greater detail. Elongated continuous cover member 15 is seen to comprise an upper portion 20 and depending side portions 21 and 22. Upper portion 20 and depending side portions 21 and 22 of cover member 15 define a generally concave enclosure which has a cross-sectional configuration which generally conforms to the cross-sectional configuration of the gas inlet pipe 9 in order to prevent undesirable particulate matter from accumulating between cover member 15 and gas inlet pipe 9, which particulate matter would enter and block gas jets 13 of gas inlet pipe 9. When the fireplace utensil 14 is placed upon gas inlet pipe 9, the longitudinal axis of cover member 15 is generally aligned with the longitudinal axis of the gas inlet pipe 9, as shown in FIG. 4, to prevent particulate matter from entering and blocking the gas inlet pipe 9 and gas jets 13. It is readily seen that the cross-sectional configuration of the concave enclosure defined by upper position 20 and depending side portion 21 and 22 of cover member 15 is generally semi-cylindrical.

Figure 5A:
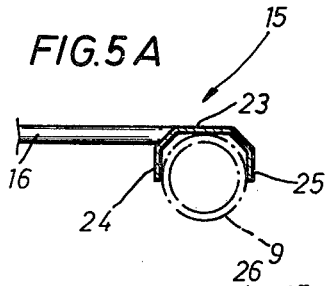
FIGS. 5A, 5B, and 5C are cross-sectional views of other embodiments of the present invention, taken along a line similar to line 4—4 of FIG. 3.

Turning now to FIG. 5A, another embodiment of cover member 15 is shown to comprise uppr portion 23 and depending side portions 24 and 25. It is readily seen that depending side portions 24 and 25 of cover member 15 are disposed substantially perpendicular to upper portion 23 of cover member 15. Once again, upper portion 23 and depending side portions 24 and 25 define a generally concave enclosure having a cross-sectional configuration which generally conforms to the cross-sectional configuration of gas inlet pipe 9.

Figure 5B:
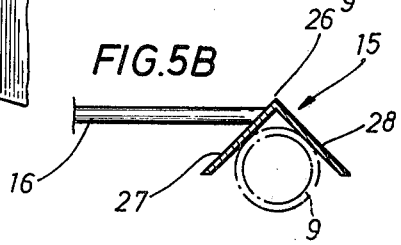

Referring now to FIG. 5B, another embodiment of cover member 15 is shown to comprise upper portion 26 and depending side portions 27 and 28. Depending side portions 27 and 28 of cover member 15 extend outwardly and obliquely from upper portion 26 of cover member 15, and define a generally concave enclosure having a cross-sectional configuration which generally conforms to the cross-sectional configuration of gas inlet pipe 9.

Figure 5C:
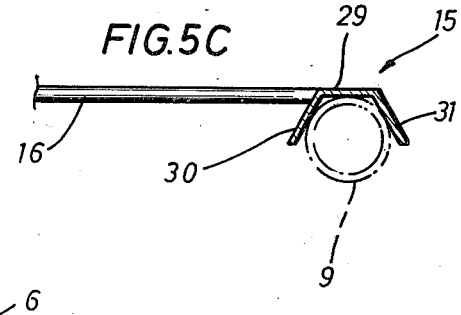

Finally referring to FIG. 5C, yet another embodiment of cover member 15 is shown to comprise upper portion 29 and depending side portions 30 and 31, and depending side portions 30 and 31 extend outwardly and obliquely from the upper portion 29 of cover member 15. Upper portion 29 and depending side portions 30 and 31 of cover member 15 define a generally concave enclosure having a cross-sectional configuration which generally conforms to the cross-sectional configuration of the gas inlet pipe 9.

The foregoing description of the invention has been directed in primary part to a particular preferred embodiment in accordance with the requirements of the Patent Statutes and for purposes of explanation and illustration. It will be apparent, however, to those skilled in this art that many modifications and changes in this specific apparatus, may be made without departing from the scope and spirit of the invention. For example, the fireplace utensil of the present invention could have a handle which extends outwardly and obliquely from the cover member, or the cover member could be comprised of a flat upper portion and depending side portions comprised of a plurality of legs or lugs.

It is applicant's intention in the following claims to cover such modifications and variations as fall within the true spirit and scope of the invention.

What is claimed is:

1. A fireplace utensil, for use in a log burning fireplace which has upper and lower portions, wherein said fireplace includes an elongated gas inlet pipe disposed with its longitudinal axis lying in a plane substantially parallel with the bottom portion of the fireplace, said gas inlet pipe having a plurality of gas jets disposed along its longitudinal axis and facing generally toward the upper portion of said fireplace for igniting the logs which comprises:

an elongated imperforate cover member having an upper portion and depending side portions, wherein the upper portion and the depending side portions of said cover member define a generally concave enclosure having a cross-sectional configuration which generally conforms to the cross-sectional configuration of said gas inlet pipe whereby undesired particulate matter from the burning logs is prevented from passing through the cover member and accumulating between the cover member and the gas inlet pipe;

an elongated handle attached to said cover member and extending outwardly from said cover member and of said fireplace; and said fireplace utensil adapted to be placed upon the gas inlet pipe, with a longitudinal axis of said cover member being generally aligned with the longitudinal axis of the gas inlet pipe to prevent particulate matter from the burning logs from entering and blocking the gas jets of the gas inlet pipe and from accumulating within the gas inlet pipe.

2. The fireplace utensil of claim 1 wherein said elongated handle is substantially perpendicular to the longitudinal axis of said cover member.

3. The fireplace utensil of claim 1 wherein one end of the elongated cover member is provided with a closure member which is contiguous with the upper portion and depending side portions of said cover member and is adapted for abutting engagement with one end of said gas inlet pipe to assist in aligning the cover member with the gas inlet pipe whereby the cover member will overlie all of the gas jets of said gas inlet pipe.

4. The fireplace utensil of claim 1 wherein the cross-sectional configuration of said enclosure is generally semi-cylindrical.

5. The fireplace utensil of claim 1 wherein said depending side portions of said cover member are disposed substantially perpendicular to said upper portion.

6. The fireplace utensil of claim 1 wherein said depending side portions of said cover member extend outwardly and obliquely from said upper portion of the cover member.

7. The fireplace utensil of claim 1 wherein one end of the elongated cover member is provided with a closure member which is partially closed and is adapted for abutting engagement with one end of said gas inlet pipe to assist in aligning the cover member with the gas inlet pipe whereby the cover member will overlie all of the gas jets of said gas inlet pipe.

* * * * *